US008006453B2

(12) United States Patent
Anderson

(10) Patent No.: US 8,006,453 B2
(45) Date of Patent: Aug. 30, 2011

(54) HANGING DISPLAY SYSTEM

(76) Inventor: Richard Anderson, Minneapolis, MN (US)

( * ) Notice: Subject to any disclaimer, the term of this patent is extended or adjusted under 35 U.S.C. 154(b) by 0 days.

(21) Appl. No.: 12/540,113

(22) Filed: Aug. 12, 2009

(65) Prior Publication Data

US 2010/0037533 A1 Feb. 18, 2010

Related U.S. Application Data

(60) Provisional application No. 61/188,810, filed on Aug. 13, 2008.

(51) Int. Cl.
*E04B 9/00* (2006.01)
*G09F 7/18* (2006.01)
*G09F 7/22* (2006.01)

(52) U.S. Cl. ..... 52/506.06; 52/39; 52/220.6; 52/506.03; 52/506.08; 248/285; 248/317; 248/320; 248/324; 248/343; 248/323; 40/584; 40/617; 362/147; 362/148; 362/404

(58) Field of Classification Search ..... 52/506.03, 52/506.04, 506.06, 506.08, 39, 220.6; 248/285, 248/317, 320, 324, 343, 489, 206.5, 323; 40/600, 617, 38, 39, 584, 648, 473, 431; 362/404, 147–150, 308, 253, 219
See application file for complete search history.

(56) References Cited

U.S. PATENT DOCUMENTS

| | | | | | |
|---|---|---|---|---|---|
| 3,155,324 | A * | 11/1964 | Chen | 362/219 |
| 3,181,274 | A * | 5/1965 | Izenour | 52/29 |
| 4,073,458 | A * | 2/1978 | Sease | 248/340 |
| 4,193,571 | A * | 3/1980 | Bula | 248/343 |
| 4,223,488 | A * | 9/1980 | Schoenung | 52/39 |
| 4,318,252 | A * | 3/1982 | Janson | 52/39 |
| 4,379,324 | A * | 4/1983 | Thompson | 362/253 |
| 4,470,213 | A * | 9/1984 | Thompson | 40/473 |
| 4,544,119 | A * | 10/1985 | Kellett et al. | 248/58 |
| 4,711,322 | A * | 12/1987 | Orndorff et al. | 187/401 |
| 5,381,991 | A * | 1/1995 | Stocker | 248/206.5 |
| 5,480,116 | A * | 1/1996 | Callas | 248/228.4 |
| 5,490,651 | A * | 2/1996 | Kump | 248/222.12 |
| 5,509,543 | A * | 4/1996 | Weaver et al. | 211/189 |
| 6,298,623 | B1 * | 10/2001 | Wendt | 52/506.06 |
| 6,851,211 | B2 * | 2/2005 | Sender | 40/617 |
| 7,712,239 | B2 * | 5/2010 | Pitcher et al. | 40/617 |
| 7,805,904 | B2 * | 10/2010 | Clark et al. | 52/506.06 |
| 2002/0195531 | A1 * | 12/2002 | Walker | 248/228.4 |
| 2006/0021271 | A1 * | 2/2006 | Pitcher | 40/658 |
| 2006/0262521 | A1 * | 11/2006 | Piepgras et al. | 362/149 |
| 2008/0190044 | A1 * | 8/2008 | Black | 52/81.3 |
| 2010/0037533 | A1 * | 2/2010 | Anderson | 52/39 |

FOREIGN PATENT DOCUMENTS

| | | | |
|---|---|---|---|
| EP | 1521032 | A1 * | 4/2005 |
| EP | 2086080 | A2 * | 8/2009 |
| JP | 07158194 | A * | 6/1995 |
| JP | 07158195 | A * | 6/1995 |
| WO | WO9714921 | * | 4/1997 |

OTHER PUBLICATIONS

International Application No. WO/97/14921, Panels for Electrically Heating Rooms With False Ceilings, Also Stabile, Publication Date: Apr. 24. 1997.*

* cited by examiner

*Primary Examiner* — Jeanette E. Chapman
(74) *Attorney, Agent, or Firm* — Daniel A. Rosenberg; Briggs and Morgan, P.A.

(57) ABSTRACT

A hanging display system is provided comprising an electrified grid system adapted for operative communication with display animation modules.

20 Claims, 6 Drawing Sheets

HANGING DISPLAY SYSTEM

CROSS-REFERENCE TO RELATED APPLICATION

The present application claims priority to, and incorporates by reference thereto, U.S. Provisional Patent Application No. 61/188,810 filed on Aug. 13, 2008 entitled Hanging Display System.

FIELD OF THE INVENTION

This invention relates to a system for hanging displays. In particular, the invention relates to an electrified hanging display system adapted for use with a wide variety of advertising and promotional signage typically used in retail environments.

BACKGROUND OF THE INVENTION

Suspended ceiling tile systems are well-known in the art. These systems are found in a wide variety of commercial buildings, and even in residential homes. Sometimes called drop-down ceilings, the systems typically are comprised of a support grid secured to the walls and/or suspended from the ceiling/roof, wherein tiles fit between the grid units.

Characteristic systems will include a perimeter molding, or edge piece, that can be affixed to the wall. The molding establishes the perimeter of the grid. Next, a series of runners are installed. The runners usually run perpendicular to the support joists and run from one wall to the next. The runners are periodically spaced to accommodate the size of the tile. The runners are often secured to the joists with chains or the like, which attach between the joists and the runners. Crossing members, or cross-tees, are then attached between the runners to complete the grid. Alternatively, in commercial applications the drop-down ceiling can be suspended from the roof or other ceiling support structures, but are otherwise similar in configuration.

With the grid in place, often electrical wiring is completed to allow for lighting, or plug access is provided for powering other electrical devices that might be attached or located in the ceiling. Furthermore, preparation for duct work is made as well. Finally tiles are fitted within the grid and dropped down into place thereby supported by the grid. Also, lighting/electrical fixture can be added at predetermined locations.

In retail environment, and elsewhere, it is not uncommon to use the grid to support signage of various types. The signs include commercial or product displays, informational signs, or any other types of signs. The signs are attached to the channels in the runners or the cross-tees. In many situations the use of these types of signs has become quite common.

In still further situations, powered or lighted signs can be used in the same manner, but only in limited circumstances. The desired location for a sign may just happen to be near an electrical outlet that can accommodate the sign. If an electrical outlet is not nearby or accessible, battery power can be used.

Both of these approaches have drawbacks. First, the location of electrical outlets is purely coincidental in connection to the decision to place signage. In the retail environment, the location of product and therefore signage is constantly changing, but the electrical outlets are static, and the layout of outlets is too sporadic and normally not designed with product layout in mind. Batteries powered signs have limitations as well. Batteries need to be replaced, and can only provide a minimal amount of power. Further, the use of batteries adds weight to the installation which can be problematic given the ceiling grids are not normally designed to support a great deal of additional weight. Also, the batteries usually will need to be turned on when the retail establishment is open, and off when closed. This is inconvenient, and can lead to simply letting the batteries run all the time, which is wasteful. Finally, batteries are a relatively expensive source of electricity.

Accordingly, a need exists for a hanging display systems that overcomes the limitations of conventional ceiling grids when it comes to the meeting the needs of hanging signs.

SUMMARY OF THE INVENTION

An object of the present invention is to provide an improved method and system for hanging displays.

These and other objects of the present invention will become apparent to those skilled in the art upon reference to the following specification, drawings, and claims.

The present invention intends to overcome the difficulties encountered heretofore. To that end a hanging display system is provided comprising an electrified grid system adapted for operative communication with display animation modules.

DETAILED DESCRIPTION OF THE PREFERRED EMBODIMENTS

Figure 1:
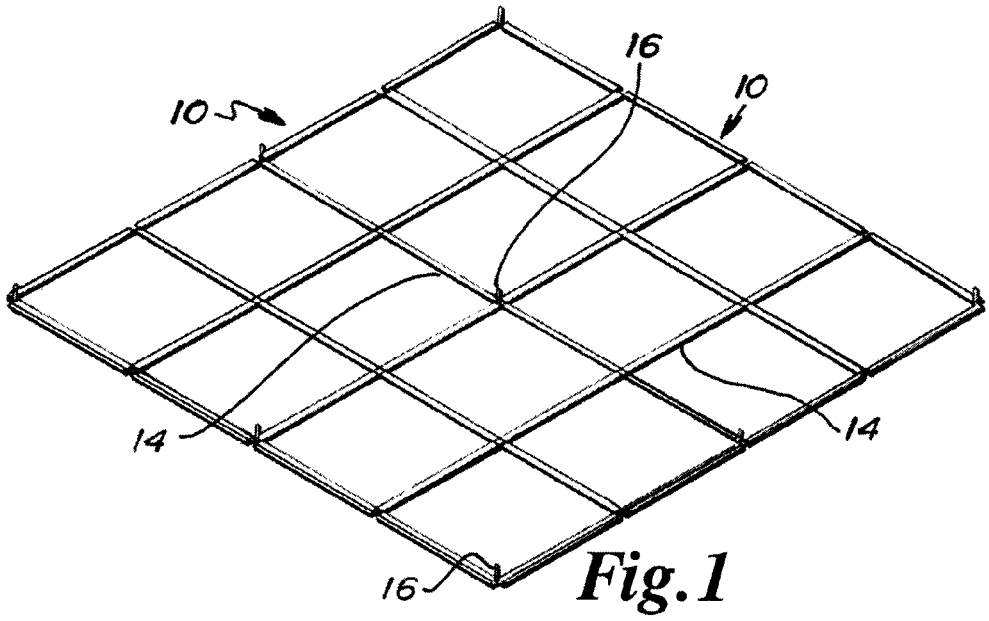
FIG. 1 is perspective view of a ceiling grid of a hanging display system.

In the Figures, is shown a hanging display system 10. FIG. 1, shows a ceiling grid 12 of the system 10, which is adapted to attach to an existing drop-down ceiling. The ceiling grid 12 includes a plurality of grid members 14 which make up the structural components of the grid 12. The grid 12 is sized to fit the pattern and size of an existing ceiling tile system. Those of ordinary skill in the art will understand that the size of the grid 12 can and will vary. The grid 12 also includes a plurality of grid mounts 16 which connect to the existing ceiling grid. The grid mounts 16 can connect using any conventional connection system, such as, screws, bolts, snap on connectors, or they can be adapted to secure to the existing runners and cross-tees of the existing drop down ceiling. Sufficient grid mounts 16 can be included to accommodate the size and weight of the ceiling grid 12. In place, the grid 12 will mount nearly flush with the existing drop-down ceiling.

Figure 2:
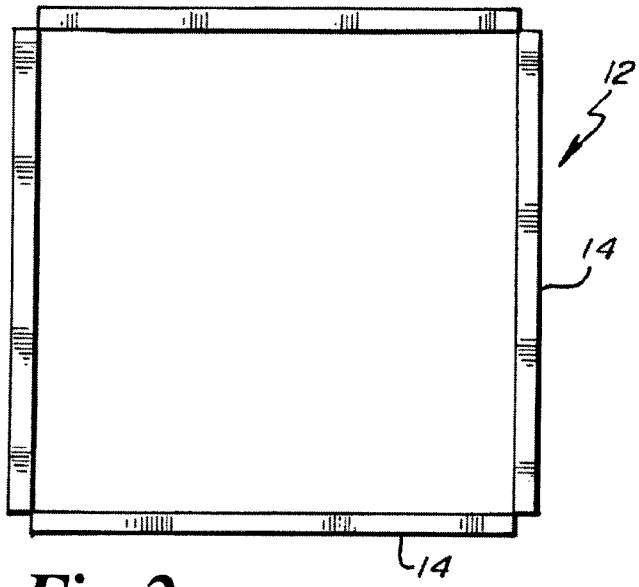
FIG. 2 is a close up view of one grid section of the ceiling grid of FIG. 1.

FIG. 2 is a view of a portion of the grid 12, showing the connection between the grid members. In this case the grid 12 is sized to match 24"×24" tiles; however, the grid 12 can be sized to a accommodate larger or smaller tiles.

Figure 3:
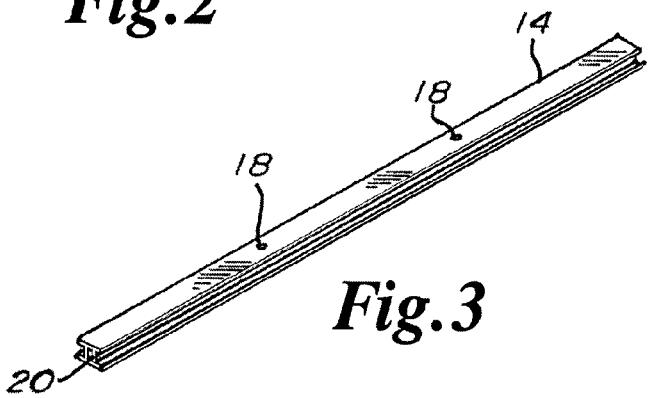
FIG. 3 is a perspective view of a grid member of the ceiling grid of FIG. 1.

FIG. 3 shows in detail a portion of a grid member 14. The grid member 14 includes periodically closely spaced holes 18 to allow for the various modules 22 of the present invention to attach above the grid 12, for example to attach to the existing drop-down ceiling grid or to roof/ceiling supports above the ceiling. The grid members 14 are also electrified with copper strips 20, or the like, to provide a continuous supply of electricity to the entire grid 12. The copper strips 20 can be located in the interior of the grid members 14, and sufficient electrical insulation is provided.

In other applications, the electrical wiring 20 can be encased within an insulated plastics housing located in the grid members 14. The wiring 20 is then partially exposed adjacent to the holes 18, or at other points along the length of the grid members 14, such that the various modules 22 can form an electrical connection with the wiring 20.

Figure 4:
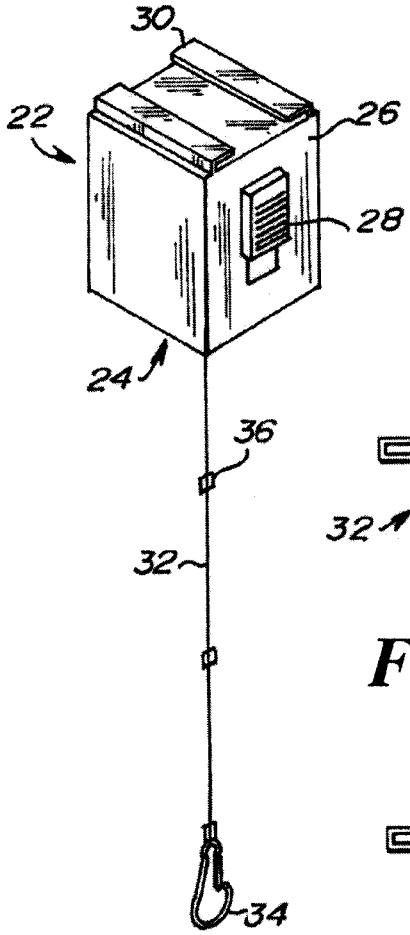
FIG. 4 is a perspective view of a hanger box of the system.
Figure 5A:
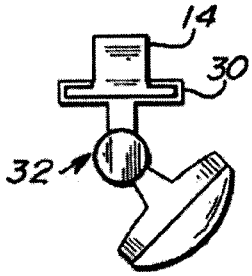
FIG. 5*a* shows a spot light for use with the system.
Figure 5B:
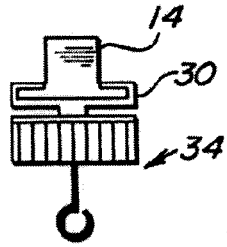
FIG. 5*b* shows a spinning motor for use with the system.
Figure 5C:
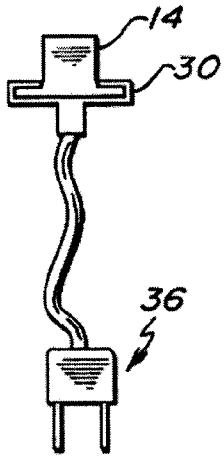
FIG. 5*c* shows a drop down power connector for use with the system.
Figure 5D:
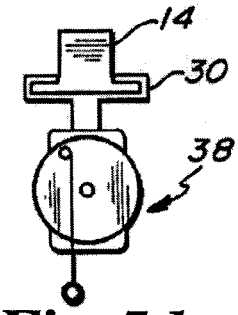
FIG. 5*d* shows a crank motor for use with the system.
Figure 5E:
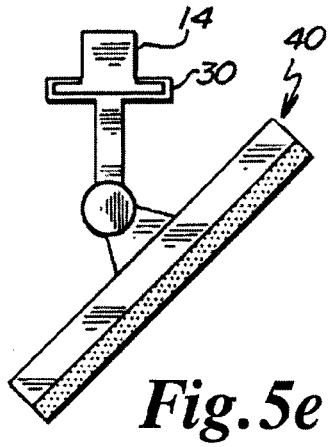
FIG. 5*e* shows a sound module for use with the system.

FIGS. 4-5 shows some of the various modules 22 of the system 10 designed for use with the grid 12. One such module 22 is a hanger box 24. The box 24 includes a body 26, a locking device 28, channel mounts 30, a cable 32, and a hook 34. The box 24 affixes to the grid members 14 of the grid 12 by affixing the channel mounts 30 to the grid members 14. The cable 32 can be drawn downward to the appropriate distance to allow for hanging a display at the optimum distance from the ground or floor. The locking device 28 can be used to hold the cable 32 in exactly the correct position. The locking device 28 can use a thumb activated pressure, or can be a more sophisticated mechanical device. The cable 32 can include markers 36 located at fixed distance along the length of the cable 32 to allow for easily determining the correct distance to draw down the cable 32. The hanging display is then secured to the hook(s) 34 for display. The hanger box 24 can be located at any point along the grid 12 as needed depending on the size and shape of the sign being secured thereto.

FIGS. 5*a-f* shows additional modules 22 that are part or the system 10. The modules 22 are electrical and generally usable to animate signage. The modules 22 are configured with channels similar to the channel mounts 30 of the hanger box 24, which allow the modules to easily connect to the grid members 14. The modules 22 connect and slidably adjustable along the length of the grid members 14, such that they maintain or come into electrical contact at any point or at predetermined intervals via the open insulated electrical connections in the grid members 14.

The modules 22 include a spot light 32 which can be used to provide sign illumination, a spinning motor 34 which can spin a sign in an attention getting manner, a drop power connector 36 to provide an easy access to an electrical outlet to be used with other modules 22 or signs, a crank motor 38 to move a sign up and down or in circles; and a sound module 40 to provide sound in association with a display. These and other modules can be used with the system 10 to provide desired animation and other effects.

Figure 6A:
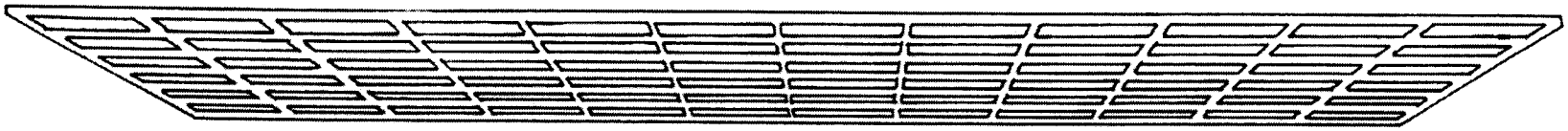
FIG. 6*a* shows a grid for use with the system.
Figure 6B:
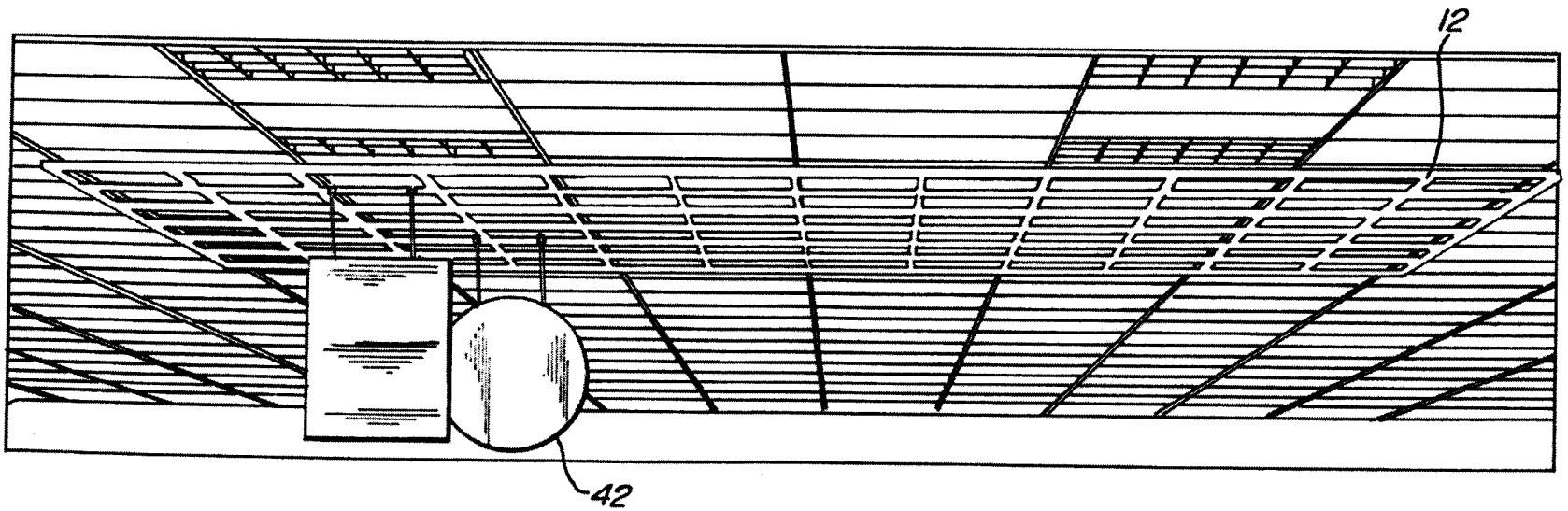
FIG. 6*b* shows the grid in use with a drop down ceiling.

FIGS. 6*a-b* show a general configuration of the system 10. FIG. 6*a* shows the grid 12 of the system 10. FIG. 6*b* shows the grid 12 secured to a conventional drop down ceiling though mounts 16. FIG. 6*b* shows the system 10 configured with conventional signage 42 for illustrative purposes.

Figure 7:
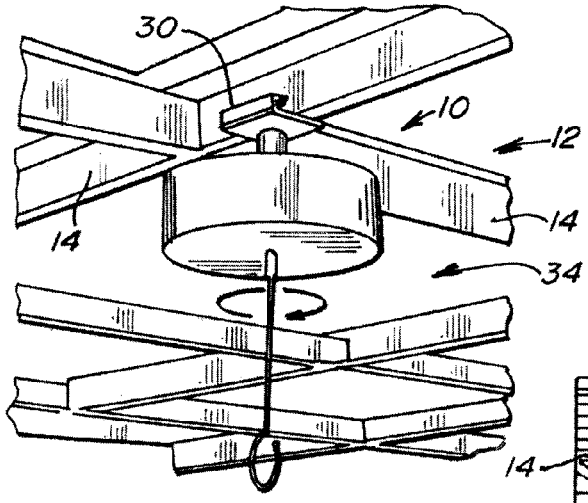
FIG. 7 shows the spinning motor of the system.

FIG. 7 shows the system 10 used with the spinning motor 34. The spinning motor 34 is secured by the channels 30 to the grid member 14, which also makes the electrical connection to power the spinning motor 34.

Figure 8:
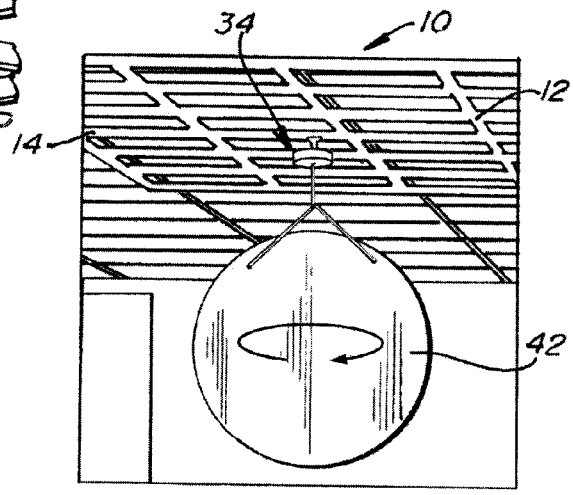
FIG. 8 shows the spinning motor and a sign of the system.

FIG. 8 shows the system 10 used with the spinning motor 34. The spinning motor 34 is secured by the channels 30 to the grid member 14, which also makes the electrical connection to power the spinning motor 34. A sign 42 is connected to the spinning motor 34 to show the system 10 in practical application.

Figure 9A:
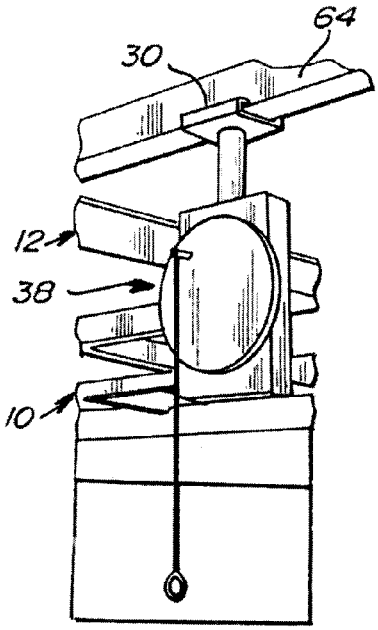
FIG. 9*a* shows the crank motor of the system.
Figure 9B:
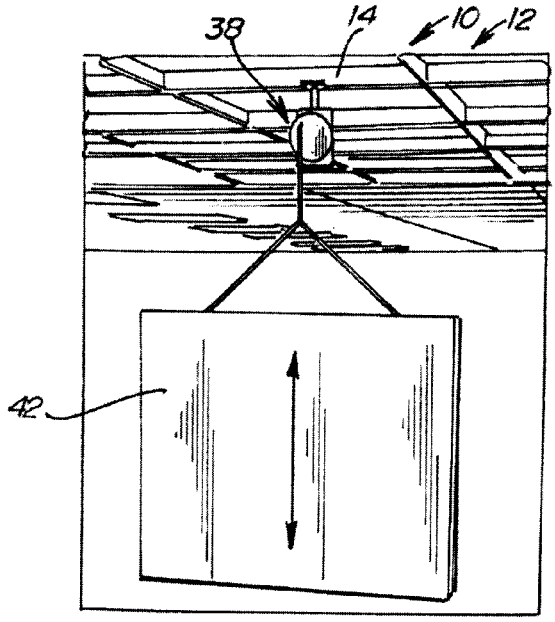
FIG. 9*b* shows the crank motor and a sign of the system.

FIGS. 9*a-b* show the system 10 used with the crank motor 38. The crank motor 38 is secured by the channels 30 to the grid member 14, which also makes the electrical connection to power the crank motor 38. FIG. 9*b* shows a sign 42 connected to the crank motor 38 to show the system 10 in practical application.

Figure 10A:
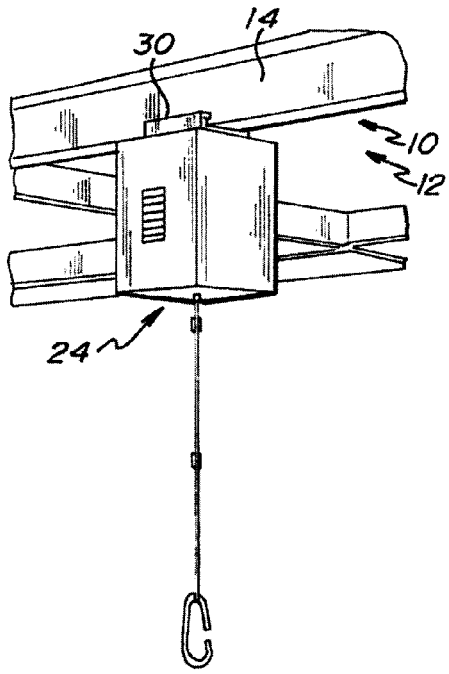
FIG. 10*a* shows the hanger box of the system.
Figure 10B:
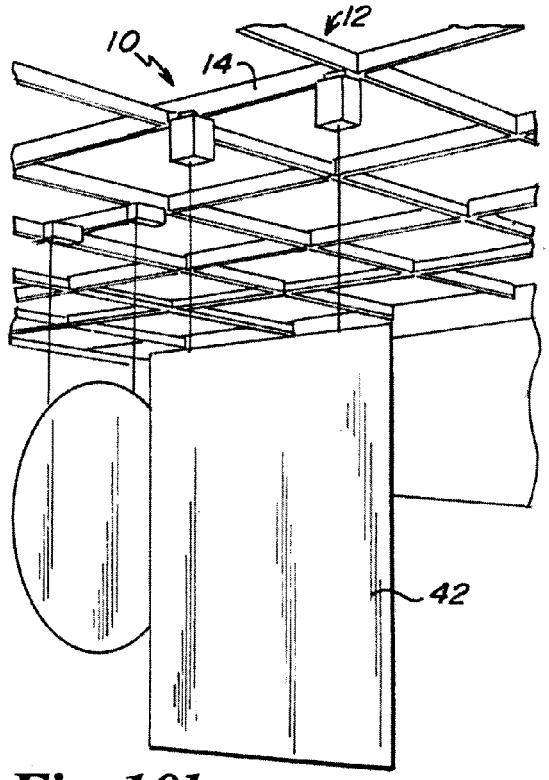
FIG. 10*b* shows hanger boxes and signs of the system.

FIGS. 10*a-b* show the system 10 used with the hanger box 24. The hanger box 24 is secured by the channels 30 to the grid member 14. FIG. 10*b* shows a sign 42 connected to two hanger boxes 24 to show the system 10 in practical application.

Figure 11A:
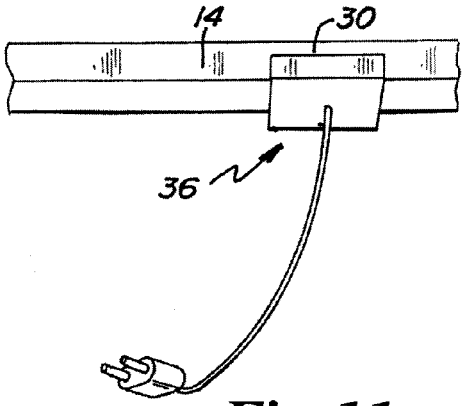
FIG. 11*a* shows the drop down connector of the system.
Figure 11B:
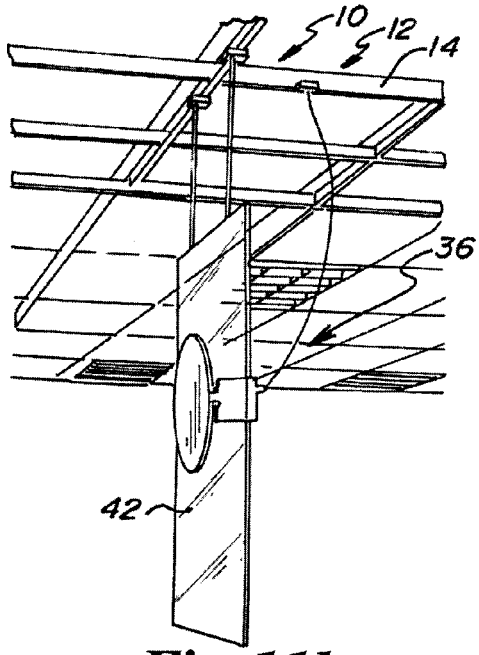
FIG. 11*b* shows the drop down connector and a sign of the system.

FIGS. 11*a-b* show the system 10 used with the drop power connector 36. The drop power connector 36 is secured by the channels 30 to the grid member 14, which also makes the electrical connection to power the drop power connector 36. FIG. 11*b* shows the drop power connector 36 in use to power a sign 42 to show the system 10 in practical application.

Figure 12A:
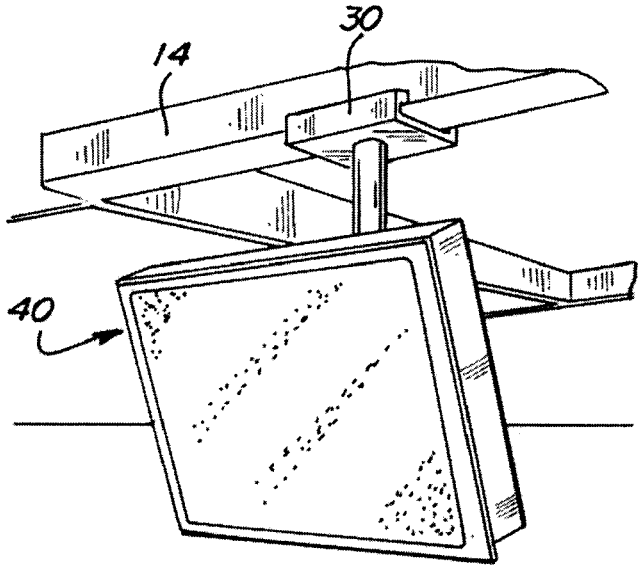
FIG. 12*a* shows the sound module of the system.

FIG. 12*a* shows the system 10 used with the sound module 40. The sound module 40 is secured by the channels 30 to the grid member 14, which also makes the electrical connection to power the sound module 40.

Figure 12B:
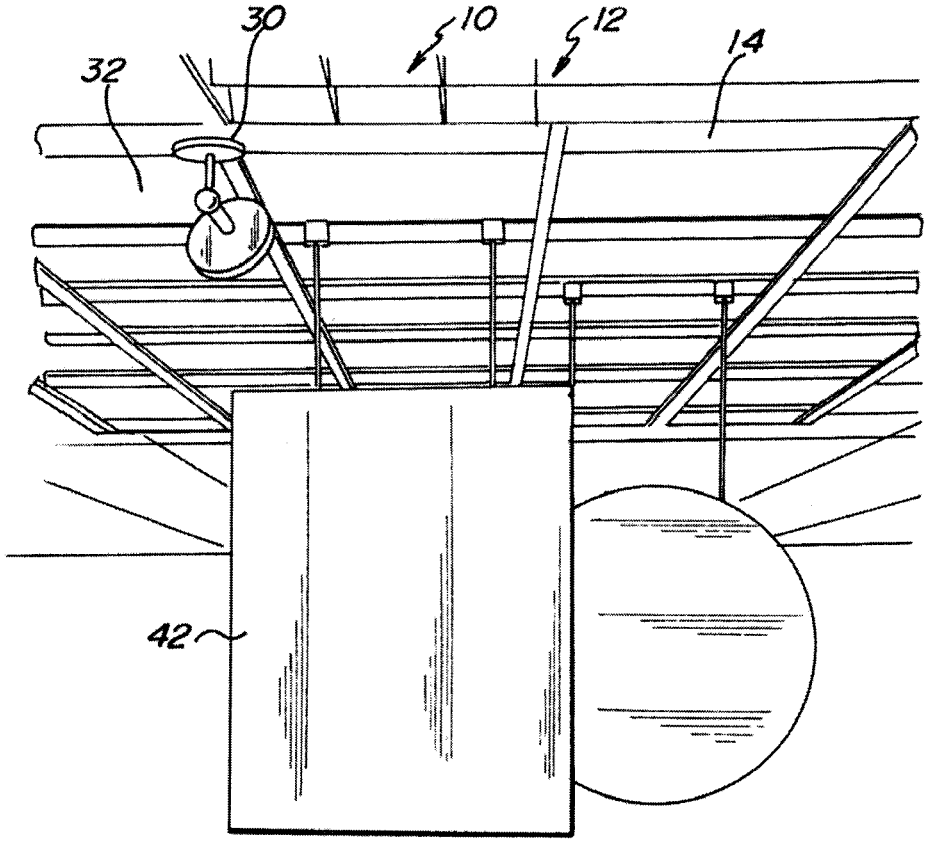
FIG. 12*b* shows the spot light of the system.

FIG. 12*b* shows the system 10 used with the spot light 32. The spot light 32 is secured by the channels 30 to the grid member 14, which also makes the electrical connection to power the spot light 32. FIG. 12*b* shows the spot light 32 used to illuminate a sign 42 to show the system 10 in practical application.

In general the system 10 is designed for low voltage operation and has the advantage of being continuously electrified. Furthermore, while the preferred embodiment of the system 10 is designed for attachment to a conventional existing drop down ceiling, the invention is not so limited. Drop down ceilings, or grid systems, can be built originally with the design of the present invention in mind; however, the present invention can be practiced without removing and replacing the existing ceiling through use of the add on system 10.

In this manner, the present invention provides an electrified hanging display system that allows for great flexibility and for the use of numerous animation and enhancement modules. In this manner, the present invention substantially eliminates the problems of the prior art.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention. Those of ordinary skill in the art that have the disclosure before them will be able to make modifications and variations therein without departing from the scope of the invention.

The invention claimed is:

1. A hanging display system, comprising:

a grid system suspended above a floor and below a drop down ceiling wherein said grid system is connected to the drop ceiling with a plurality of grid mounts;

a display module operatively securable to said grid system;

a sign proximate to said module; and wherein the grid system is electrified and provides power to said display.

2. The system of claim 1 wherein the grid system is comprised of interconnected perpendicularly aligned members.

3. The system of claim 1 wherein the members are I-shaped in cross-section.

4. The system of claim 3 wherein the members comprise an inner chamber having electrical supply distributed through said inner chamber.

5. The system of claim 4 wherein said electrical supply is provided by copper strips secured within said inner chamber.

6. The system of claim 5 wherein said members are electrically insulated.

7. The system of claim 2 wherein the members have periodically spaced holes to allow said modules to be in operative communication with structures above said grid.

8. The system of claim 1 wherein said grid system is structurally suspended from a ceiling.

9. The system of claim 8 wherein said ceiling is a drop down ceiling.

10. The system of claim 9 wherein said grid system is structurally suspended to walls.

11. The system of claim 1 wherein said display module is suspended from structural roof members.

12. The system of claim 1 wherein said module is a hanger box.

13. The system of claim 1 wherein said module is a spot light.

14. The system of claim 1 wherein said module is a spinning motor.

15. The system of claim 1 wherein said module is a drop down power connector.

16. The system of claim 1 wherein said module is a crank motor.

17. The system of claim 1 wherein said module is a sound module.

18. The system of claim 3 wherein said module has a channel shaped to engage with said I-shaped cross-section of at least one of said members.

19. The system of claim 18 wherein said grid is an electrified grid.

20. The system of claim 19 wherein said engagement between said module and said member is an electrical engagement.

* * * * *

UNITED STATES PATENT AND TRADEMARK OFFICE

CERTIFICATE OF CORRECTION

PATENT NO. : 8,006,453 B2
APPLICATION NO. : 12/540113
DATED : August 30, 2011
INVENTOR(S) : Anderson It is certified that error appears in the above-identified patent and that said Letters Patent is hereby corrected as shown below:

On the title page
In Item (76) Inventor:
Please delete "Richard Anderson" and insert in its place -- Rick David Anderson --

Signed and Sealed this
Twenty-ninth Day of November, 2011

David J. Kappos

David J. Kappos
*Director of the United States Patent and Trademark Office*